United States Patent [19]

Seitz

[11] 4,319,429

[45] Mar. 16, 1982

[54] AUXILIARY CRANK END

[75] Inventor: Robert F. Seitz, Mentor, Ohio

[73] Assignee: The Youngstown Steel Door Company, Cleveland, Ohio

[21] Appl. No.: 180,864

[22] Filed: Aug. 25, 1980

[51] Int. Cl.[3] ..... E05D 15/10

[52] U.S. Cl. ..... 49/220

[58] Field of Search ..... 49/220, 219, 218, 426

[56] References Cited

U.S. PATENT DOCUMENTS

| | | | |
|---|---|---|---|
| 3,913,269 | 10/1975 | Ross, Jr. | 49/220 |
| 4,129,965 | 12/1978 | Reynolds et al. | 49/220 |
| 4,142,328 | 3/1979 | Saffrahn | 49/220 |
| 4,178,857 | 12/1979 | Madland | 49/220 X |

*Primary Examiner*—Philip C. Kannan

*Attorney, Agent, or Firm*—Bruce M. Winchell

[57] ABSTRACT

A railway house car has plug doors, each with a pair of rotationally driven top operating cranks and an auxiliary crank in engagement with a c-shaped top retainer. The auxiliary crank is mounted between the operating cranks on a lower vertical crank end for rotation relative to the door. An upper vertical crank end of the auxiliary cranks has mounted thereon a front sled moveably engaging the inner surface of the downwardly extending front flange of the top retainer and a bottom sled moveably engaging the upper surface of the laterally outwardly extending lower flange of the top retainer. The bottom sled and lower flange extend outwardly beyond the front sled and front flange to resist the auxiliary crank's outward pivotal movement and separation from the retainer and any door displacement as a result. The sleds provide large load bearing surface areas to resist distortion and are spaced and mounted on the common vertical axis of the upper vertical crank end for rotation independent of each other.

8 Claims, 7 Drawing Figures

FIG. 1
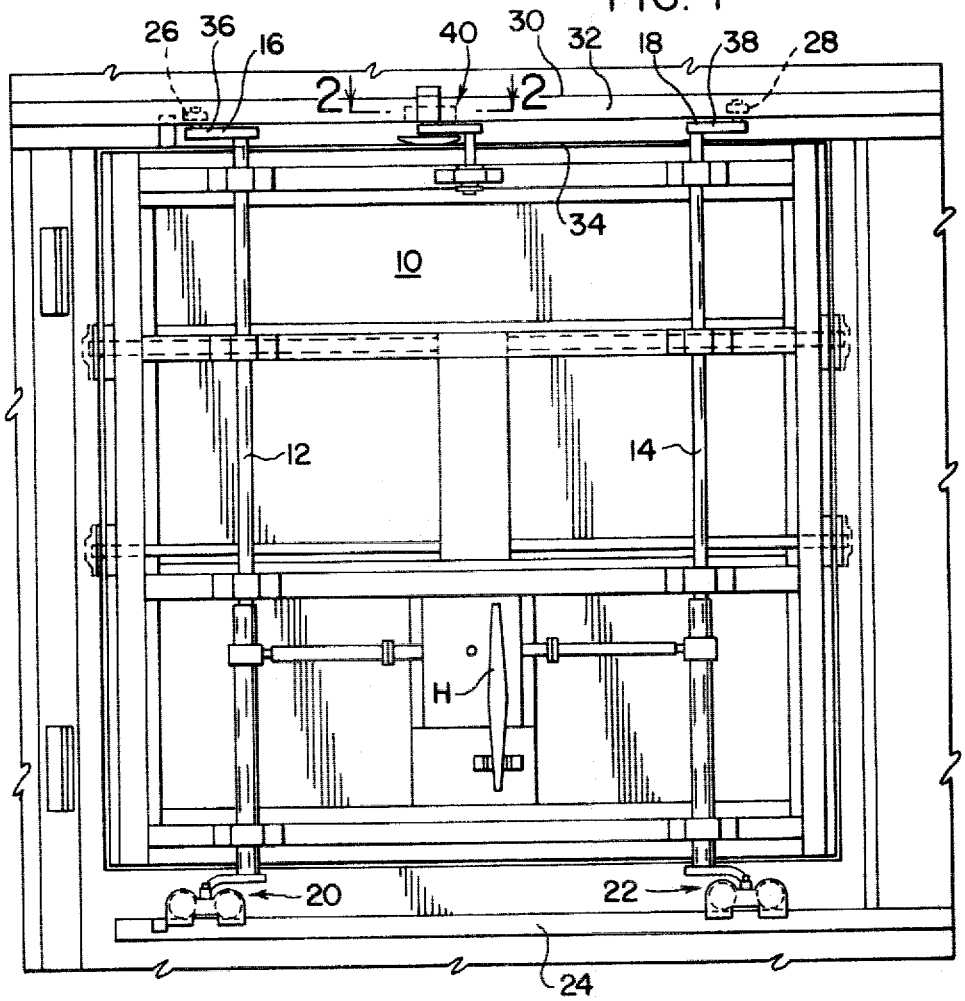
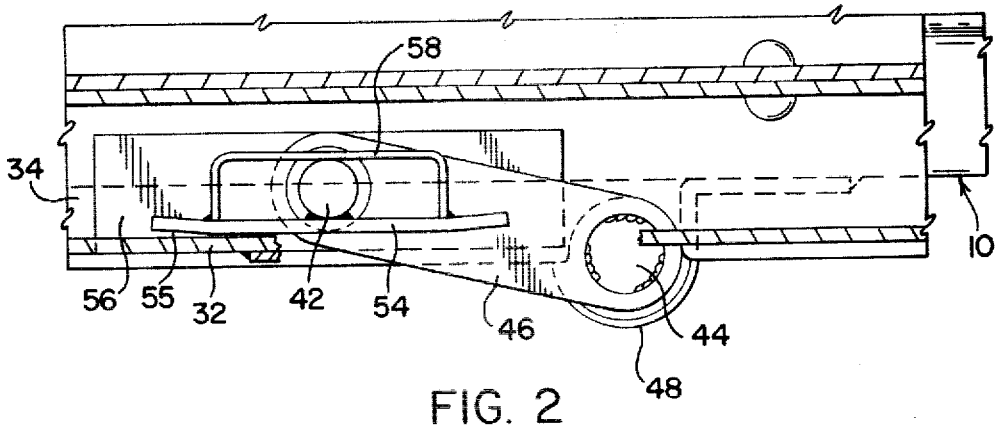
FIG. 2

FIG. 5
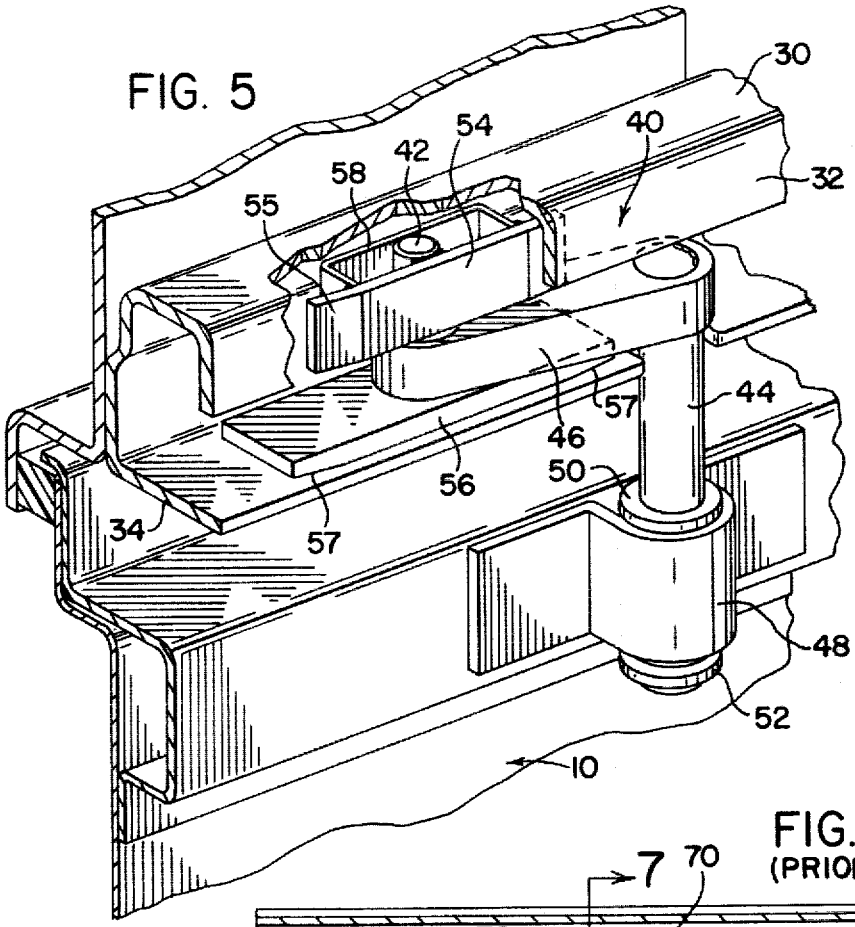
FIG. 6
(PRIOR ART)
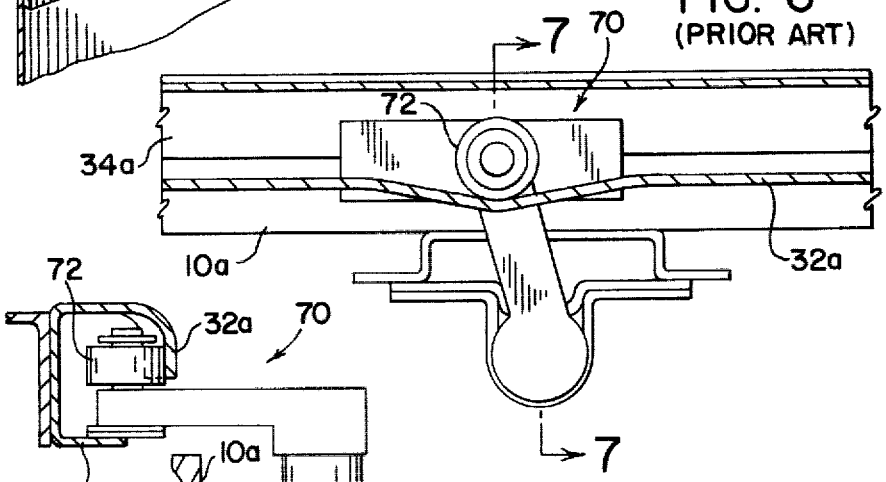
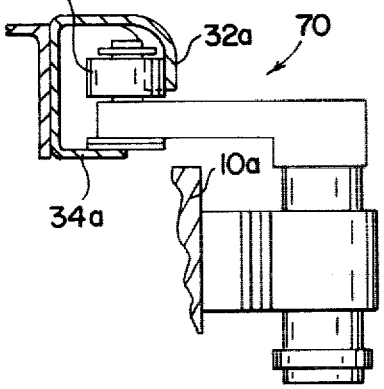
FIG. 7
(PRIOR ART)

AUXILIARY CRANK END

BACKGROUND OF THE INVENTION

The invention relates to auxiliary cranks for plug doors of railway house cars. Plug doors typically have a pair of rotationally driven top operating cranks with a top auxiliary crank mounted therebetween to minimize the danger of the cranks separating from a c-shaped longitudinal top retainer in which they move and any door displacement as a result thereof.

The prior art has recognized the need for auxiliary cranks in U.S. Pat. Nos. 3,913,269 to Ross, 4,129,965 to Reynolds, and 4,142,328 to Saffrahn. The Ross U.S. Pat. No. 3,913,269 utilizes only a single roller on the auxiliary crank to engage the inside of the c-shaped longitudinal retainer. The Reynolds U.S. Pat. No. 4,129,965 utilizes what it terms is a "shuttle means". The structure includes a "load bearing skirt" for engagement only "in case of failure" with the c-shaped retainer's lower flange at a location inside of the engagement of a front sled and the downwardly extending front flange. In this patent the load bearing skirt "in case of failure" will act as a fulcrum about which the front sled will pivot with great force against the inside of the front flange thereby tending to distort it to a point of displacement of the plug door. The Saffrahn U.S. Pat. No. 4,142,328 utilizes a front roller and a bottom sled engaging the c-shaped retainer inside of the location of engagement of the front roller with the inside of the c-shaped longitudinal retainer. Saffrahn's structure, accordingly, can create a moment of force about the bottom sled tending to pivot and separate the auxiliary crank from the c-shaped longitudinal retainer and thereby displace the door.

SUMMARY OF THE INVENTION

The present invention minimizes the problems of the prior art patents which result from their tendency for the auxiliary crank of a plug door during undesirable displacement of the door to deform the c-shaped longitudinal top retainer. The invention accomplishes this by utilizing a front sled and a bottom sled extending outside of the front sled both of which sleds provide relatively large and therefore non-deforming load bearing surfaces.

In a railway house car having plug doors, the door is driven into and out of its opening by means which include a pair of rotationally driven top operating cranks. An auxiliary crank is mounted between the top operating cranks. All of the cranks have upper vertical crank ends extending into a c-shaped longitudinal top retainer which is located along the top and adjacent to the door opening. The auxiliary crank is mounted by means of a lower vertical crank end for rotation relative to the door. Its upper vertical end has a front sled mounted thereon for engaging the inner surface of the downwardly extending front flange of the c-shaped top retainer and a bottom sled for engaging the outwardly extending lower flange of the c-shaped top retainer. In order to resist pivoting of the front sled with great force against the front flange, in the event it becomes necessary for the auxiliary crank to retain the door in place, the lower flange and bottom sled include an area of engagement outside of the location of engagement of the front sled with the front flange of the top retainer.

To insure that the sleds move easily along the surfaces of the c-shaped top retainer during operation of the door, the sleds are mounted for rotation about a common axis and have upturned ends. Both sleds rotate about the axis of the annular upper vertical crank end of the auxiliary crank. The front sled is fixed to a top portion of the pin which is the upper vertical crank end and the bottom sled is fixed to the bottom of the pin and rotates with it as it turns within a hole in the end of the horizontal portion of the auxiliary crank which connects it to the lower vertical crank end.

BRIEF DESCRIPTION OF THE DRAWINGS

FIG. 1 is a front elevational view of a plug door constructed according to the present invention.

FIG. 2 is a cross-sectional view along the line 2—2 in FIG. 1.

FIG. 5 is a perspective view of the portion of the structure shown in FIGS. 2–4.

FIG. 6 is a cross-sectional view similar to FIG. 2 showing a prior art arrangement.

FIG. 7 is a cross-sectional view taken along the line 7—7 of FIG. 6.

DESCRIPTION OF THE PREFERRED EMBODIMENTS

Figure 3:
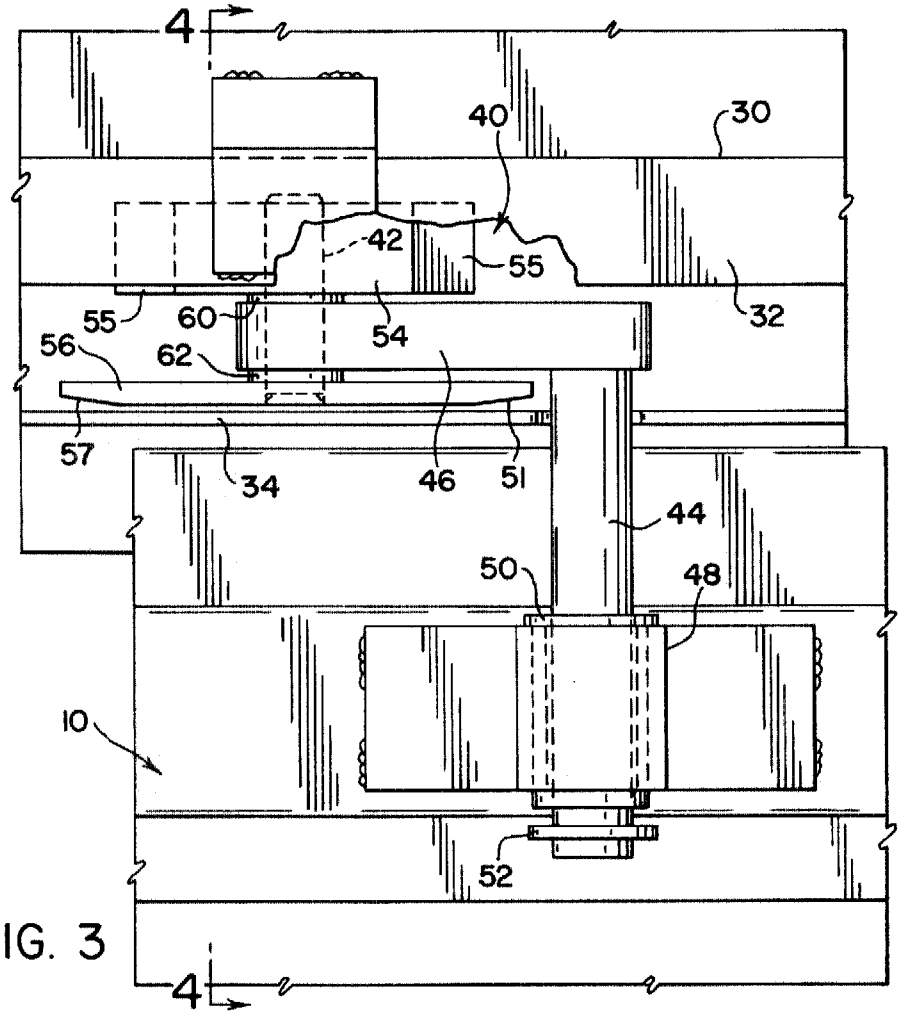
FIG. 3 is a fragmentary elevational view of the portion of the structure shown in FIG. 2.
Figure 4:
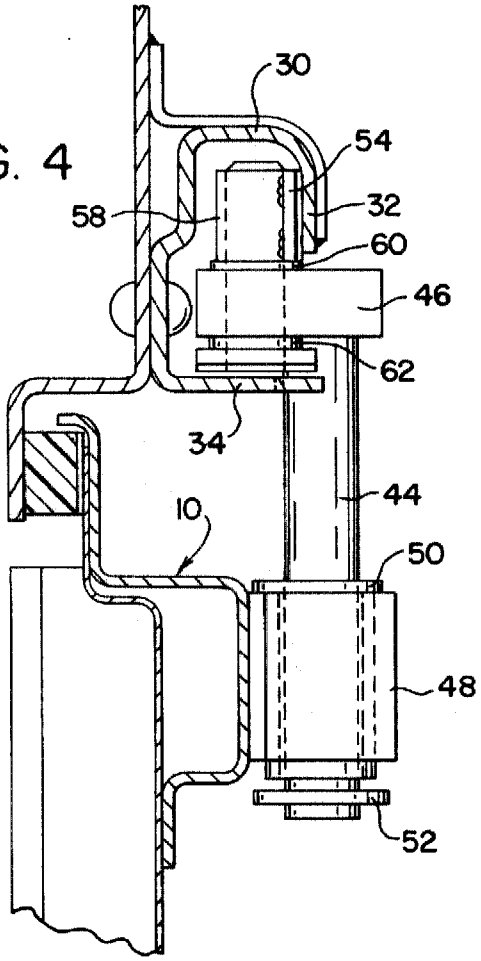
FIG. 4 is a cross-sectional view taken along the line 4—4 of FIG. 3.

The numeral 10 generally designates a plug door mounted in the side opening of a railway house car. The door 10 is moved laterally of the car into and out of the opening by means of a pair of rotatable operating pipes 12 and 14 having top cranks 16 and 18, respectively, and lower crank and roller assemblies 20 and 22. Rotation of handle H rotates pipes 12 and 14 in a manner well known and understood in the art. The door 10 rides on a longitudinal track 24 by means of lower crank and roller assemblies 20 and 22 for movement longitudinally along the car side into and out of register with the door opening.

Upper vertical ends of cranks 16 and 18 include pins with rollers 26 and 28 mounted for longitudinal movement within and along a top retainer or longitudinal retainer means 30 having a generally c-shaped cross-section. The top retainer 30 is mounted along the top and adjacent to the door opening and functions to retain the top of the door and prevent its undesirable displacement. Rollers 26 and 28 move along the inner surface of a downwardly extending front flange 32 of top retainer 30. The front flange 32 extends longitudinally and is located inside, in the direction of the car side, of the outer edge of a laterally outwardly extending lower flange 34 spaced from and located below front flange 32. Horizontal connecting portions 36 and 38 of top operating cranks 16 and 18 extend through the space between front flange 32 and lower flange 34 and connect the upper ends of the cranks and their rollers 26 and 28 with lower vertical extending ends fixed to operating pipes 12 and 14.

Mounted on the top of the door 10 between the pair of top operating cranks 16 and 18 is an auxiliary crank 40. The purpose of the crank 40 is to retain the door top against undesirable displacement in the event the door 10 becomes disengaged from track 24 or is damaged in a manner which makes reliance of the top operating cranks 16 and 18 for retaining the top of the door in proper position uncertain or impossible.

The auxiliary crank 40 includes an upper vertical crank end in the form of a pin portion 42, an annular lower vertical crank end portion 44 and a horizontal connecting portion 46 between the two which extends through the space between front flange 32 and bottom flange 34. The lower vertical crank end portion 44 is mounted for rotation relative to the door 10 by means of a fulcrum or strap mounted bushing assembly 48 and retainer rings 50 and 52. The auxiliary crank 40 rotationally "floats" as the door moves relative to the c-shaped top retainer 30 as a result of a front sled 54 in engagement with the inner surface of front flange 32 and a bottom sled 56 in engagement with the upper surface of lower flange 34.

The ends of sleds 54 and 56 are tapered as shown at 55 and 57 respectively from intermediate the ends of its respective surface in engagement with a flange of the top retainer outwardly away from the surface of either flange 32 or 34 with which it is in engagement. The front sled 54 is mounted on a rectangular frame member 58 and is welded to pin 42 adjacent its upper end and above horizontal connecting portion 46 of crank 40. The bottom sled 56 is welded to the end of pin 42 below connecting portion 46. Washers 60 and 62 enhance relative rotational movement between connecting portion 46 and pin 42 and the sleds 54 and 56 mounted thereon as they move along the top retainer 30 during movement of the door 10.

When the door 10 is secured within its opening in the side of the railway car, the sleds 54 and 56, because of their relatively large load bearing areas in contact with the flanges 32 and 34 resist damage to these flanges which the line contact of rollers often cause due to vibrations set up as the railway car moves along a track. A recognition of this problem and a somewhat different solution was discussed in U.S. Pat. No. 4,178,857, to Madland.

The large area of contact of sled 54 also minimizes the tendency of prior art auxiliary cranks' rollers to deform front flanges of a top retainer. FIGS. 6 and 7 show a prior art auxiliary crank 70 with a roller 72 deflecting a front flange **32*a* as a result of top loads on the door 10*a* tending to pivot the top of door 10*a* outwardly. A laterally outwardly extending lower flange 34*a* in this prior art arrangement, which is of the type shown in U.S. Pat. No. 4,142,328 to Saffrahn discussed above, does not extend laterally outwardly of flange 32*a*. By way of contrast, the lower flange 34 of the instant invention extending laterally outwardly of front sled 54 and front flange 32 tends to allow the top rollers 26 and 28** to absorb stress during periods of maximum load.

I claim:

1. In a railway house car having openings along its sides, doors for closing said openings by movement along said car sides and laterally into and out of said openings;

bottom and top rotating crank means moveably supporting and retaining said doors adjacent the lower portions of said doors on longitudinal track means and adjacent the upper portions of said doors within longitudinal retainer means;

means to rotationally drive at least some of said crank means for selective lateral movement of said doors, the improvement comprising;

said longitudinal retaining means including a downwardly extending front flange and a laterally outwardly extending lower flange below and spaced from said front flange by an amount sufficient to permit passage of an elongated and generally horizontally oriented intermediate portion of said top crank means;

one of said top crank means including a front sled moveably engaging the inner surface of said downwardly extending front flange; and, said one top crank means including a bottom sled moveably engaging the upper surface of said laterally outwardly extending lower flange laterally outwardly of said front sled and said inner surface of said downwardly extending front flange it engages.

2. The structural combination of claim 1 in which said one of said top crank means including a sled is mounted between two of said rotationally driven crank means and acts as an auxiliary retaining crank means.

3. The structural combination of claim 1 in which each of said sleds is tapered from intermediate the ends of its respective surface in engagement with said longitudinal retainer means outwardly away from the surface of said retainer means with which said respective surface is in engagement.

4. The structural combination of claim 1 in which said longitudinal retaining means is a structural member which is generally c-shaped in cross-section.

5. The structural combination of claim 1 in which said one top crank means includes an upper vertical portion, a lower vertical portion and an elongated and generally horizontally oriented intermediate portion therebetween, the upper vertical portion having said front sled and said bottom sled mounted thereon and the lower vertical portion mounted on said door for rotation relative thereto.

6. The structural combination of claim 5 in which said upper vertical portion is annular and said front sled and bottom sled are mounted for rotation about the axis of said vertical portion as they move along said longitudinal retainer means.

7. The structural combination of claim 6 in which said front sled and said bottom sled are spaced from each other and said horizontally oriented intermediate portion intersects and joins to said annular upper vertical portion in the space between said front sled and said bottom sled.

8. The structural combination of claim 7 in which said bottom sled is fixed to said annular upper vertical portion and rotates therewith.

* * * * *